US005089688A

United States Patent [19]

Fang et al.

[11] Patent Number: 5,089,688

[45] Date of Patent: Feb. 18, 1992

[54] COMPOSITE CIRCUIT PROTECTION DEVICES

[75] Inventors: Shou-Mean Fang, Union City; David A. Horsma; Guillaume Peronnet, both of Palo Alto, all of Calif.; Timothy E. Fahey, Williamsport, Pa.; Andrew N. Au, Fremont; William D. Carlomagno, Redwood City, both of Calif.

[73] Assignee: Raychem Corporation, Menlo Park, Calif.

[21] Appl. No.: 456,030

[22] Filed: Dec. 22, 1989

Related U.S. Application Data

[63] Continuation of Ser. No. 124,696, Nov. 24, 1987, abandoned, which is a continuation-in-part of Ser. No. 115,089, Oct. 30, 1987, abandoned, which is a continuation-in-part of Ser. No. 754,807, Jul. 12, 1985, abandoned, which is a continuation-in-part of Ser. No. 628,945, Jul. 10, 1984, abandoned.

[51] Int. Cl.[5] ..... H05B 1/02

[52] U.S. Cl. ..... 219/505; 219/510; 219/209; 219/494; 338/22 R

[58] Field of Search ..... 219/494, 490, 501, 505, 219/504, 508–510, 511, 209, 523, 528, 553; 338/22 R

[56] References Cited

U.S. PATENT DOCUMENTS

| | | | |
|---|---|---|---|
| 3,287,684 | 11/1966 | Armbruster | 338/211 |
| 3,805,022 | 4/1974 | Kulwicki | 219/505 |
| 3,861,029 | 1/1975 | Smith-Johannsen et al. | 29/611 |
| 3,976,854 | 8/1976 | Ishikawa | 219/505 |
| 4,034,207 | 7/1977 | Tamada et al. | 219/517 |
| 4,037,082 | 7/1977 | Tamada et al. | 219/541 |
| 4,051,550 | 9/1977 | Seno | 361/402 |
| 4,099,216 | 7/1978 | Weberg | 361/56 |
| 4,162,395 | 7/1979 | Kobayashi et al. | 219/367 |
| 4,174,511 | 11/1979 | Knapp | 337/107 |
| 4,177,446 | 12/1979 | Diaz | 338/212 |
| 4,177,785 | 12/1979 | Sundeen | 123/179 |
| 4,237,441 | 12/1980 | Van Konynenburg et al. | 338/22 |
| 4,388,607 | 6/1983 | Toy et al. | 338/22 |
| 4,400,614 | 8/1983 | Sopory | 219/528 |
| 4,408,244 | 10/1983 | Weible | 361/24 |
| 4,413,174 | 11/1983 | Ting | 219/511 |
| 4,413,301 | 11/1983 | Middleman | 361/106 |
| 4,426,339 | 1/1984 | Kamath et al. | 264/22 |
| 4,445,026 | 4/1984 | Walker | 219/553 |
| 4,459,473 | 7/1984 | Kamath | 219/505 |
| 4,467,310 | 8/1984 | Jakab | 338/22 |
| 4,475,012 | 10/1984 | Coulmance | 179/81 |
| 4,481,498 | 11/1984 | McTavish et al. | 338/20 |
| 4,514,620 | 4/1985 | Cheng | 219/553 |
| 4,542,365 | 9/1985 | McTavish et al. | 338/20 |
| 4,549,161 | 10/1985 | McTavish et al. | 338/20 |
| 4,577,094 | 3/1986 | Mills | 219/505 |
| 4,629,869 | 12/1986 | Bronnvall | 219/553 |
| 4,724,417 | 2/1988 | Au | 338/22 |
| 4,743,321 | 5/1988 | Soni | 156/85 |

FOREIGN PATENT DOCUMENTS

| | | |
|---|---|---|
| 38718 | 10/1981 | European Pat. Off. . |
| 87884 | 9/1983 | European Pat. Off. . |
| 93647 | 1/1984 | European Pat. Off. . |
| 2434006 | 2/1976 | Fed. Rep. of Germany . |
| 2644256 | 3/1978 | Fed. Rep. of Germany . |
| 2825442 | 12/1979 | Fed. Rep. of Germany . |
| 2946842 | 5/1981 | Fed. Rep. of Germany . |
| 31283 | 7/1981 | Fed. Rep. of Germany . |
| 2528253 | 12/1983 | France . |

*Primary Examiner*—Mark H. Paschall
*Attorney, Agent, or Firm*—Marguerite E. Gerstner; Timothy H. P. Richardson; Herbert G. Burkard

[57] ABSTRACT

Circuit protection devices which comprise a PTC conductive polymer element and a second electrical component which is thermally coupled to the PTC element and which, when a fault causes the current in the circuit to become excessive, generates heat which is transferred to the PTC element, thus reducing the time taken to "trip" PTC element. The second component is for example a voltage-dependent resistor which is connected in series with the PTC element under the fault conditions and is thus protected from damage. Alternatively, the second component is a thick film resistor which is connected in series with the PTC element.

23 Claims, 2 Drawing Sheets

COMPOSITE CIRCUIT PROTECTION DEVICES

CROSS-REFERENCE TO RELATED APPLICATIONS

This application is a continuation of application Ser. No. 124,696 filed Nov. 24, 1987, abandoned which is a continuation-in-part of application Ser. No. 115,089 filed Oct. 30, 1987 by Fang, Horsma, Peronnet, Fahey, Au and Carlomagno, now abandoned, which is in itself a continuation-in-part of application Ser. No. 754,807, filed July 12, 1985 by Fahey, Au and Carlomagno, now abandoned in favor of a continuation application Ser. No. 150,005, filed Feb. 4, 1988, now U.S. Pat. No. 4,780,598. Ser. No. 754,807 is itself a continuation-in-part of application Ser. No. 628,945, now abandoned, filed July 10, 1984 by William D. Carlomagno. This application is also related to application Ser. Nos. 455,715 and 456,615 which are continuation applications of Ser. No. 124,696 and which are filed contemporaneously with this application. The disclosure of each of these applications is incorporated herein by reference.

BACKGROUND OF THE INVENTION

1. Field of the Invention

This invention relates to circuit protection devices comprising PTC conductive polymers.

2. Introduction to the Invention

Conductive polymer and ceramic compositions exhibiting PTC behavior, and electrical devices comprising them, are well known. Reference may be made, for example, to U.S. Pat. Nos. 2,952,761, 2,978,665, 3,243,753, 3,351,882, 3,571,777, 3,757,086, 3,793,716, 3,823,217, 3,858,144, 3,861,029, 3,950,604, 4,017,715, 4,068,281, 4,072,848, 4,085,286, 4,117,312, 4,177,376, 4,177,446, 4,188,276, 4,237,441, 4,242,573, 4,246,468, 4,250,400, 4,252,692, 4,255,698, 4,271,350, 4,272,471, 4,304,987, 4,309,596, 4,309,597, 4,314,230, 4,314,231, 4,315,237, 4,317,027, 4,318,881, 4,327,351, 4,330,704, 4,334,351, 4,352,083, 4,388,607, 4,398,084, 4,413,301, 4,425,397, 4,426,339, 4,426,633, 4,427,877, 4,435,639, 4,429,216, 4,442,139, 4,450,496, 4,459,473, 4,459,632, 4,475,012, 4,481,498, 4,476,450, 4,502,929, 4,514,620, 4,515,449, 4,534,889, 4,542,365, 4,545,926, 4,549,161, 4,560,498, 4,562,313, 4,647,894, 4,647,896, 4,685,025 and 4,689,475, and commonly assigned U.S. Ser. No. 103,077 (Fang, et al.), now abandoned in favor of a continuation application, Ser. No. 293,542, filed Jan. 3, 1989, and 115,089 filed by Fang, et al. on Oct. 30, 1987, now abandoned. The disclosure of each of the patents and applications referred to above is incorporated herein by reference.

Particularly useful devices comprising PTC conductive polymers are circuit protection devices. Such devices have a relatively low resistance under the normal operating conditions of the circuit, but are "tripped", i.e., converted into a high resistance state, when a fault condition, e.g., excessive current or temperature, occurs. When the device is tripped by excessive current, the current passing through the PTC element causes it to self heat to an elevated temperature at which it is in a high resistance state. Such devices, and PTC conductive polymer compositions for use in them, are described for example in U.S. Pat. Nos. 4,237,411, 4,238,812; 4,255,698; 4,315,237; 4,317,027; 4,329,726; 4,352,083; 4,413,301; 4,450,496; 4,475,138; 4,481,498; 4,534,889; 4,562,313; 4,647,894; 4,647,896; and 4,685,025 and in copending commonly assigned U.S. application Ser. Nos. 141,989, 711,909, now U.S. Pat. No. 4,774,024, Ser. No. 711,910, now U.S. Pat. No. 4,724,417, and Ser. No. 103,077, now abandoned. When the circuit protection device is "tripped", a thermal gradient is created. Where the thermal gradient flows in the same direction as the current flow, measures can be taken to assure that the peak temperature of the thermal gradient, i.e. the "hotline" or "hotzone" does not form near an electrode. Such preventative measures are described in U.S. Pat. Nos. 4,317,027 and 4,352,083. The disclosure of each of these patents and pending applications is incorporated herein by reference.

A particularly important use for circuit protection devices is in telecommunications apparatus, which can be exposed to a variety of different fault conditions. Reference may be made for example to U.S. Pat. Nos. 4,068,277, 4,068,281, 4,475,012, 4,459,632, 4,562,313, 4,647,894, 4,647,896 and 4,685,025, and application Ser. No. 711,909, now U.S. Pat. No. 4,774,024, Ser. No. 711,910, now U.S. Pat. No. 4,724,417, and Ser. No. 103,077, now abandoned, the disclosures of which are incorporated herein by reference.

SUMMARY OF THE INVENTION

We have now discovered that improved protection of circuits against excessive currents (and the voltages which produce such currents) can be obtained through the use of composite protection devices which comprise a PTC conductive polymer element and a second electrical component which, under at least some of the fault conditions against which protection is needed, modifies the response of the PTC element to the fault conditions in a desired way. For example, the second component may be a resistor which, under the fault conditions, generates heat which is transferred to the PTC element and thus reduces the "trip time" of the device (i.e. the time taken to convert the PTC element into a high resistance, high temperature state such that the circuit current is reduced to a safe level). The second component may function substantially only to reduce the trip time, but it is preferably part of the circuit protection system. The reduction of the current by the PTC element may serve to protect the second component and/or to protect other components of the circuit.

The use of a PTC conductive polymer in such devices offers very important advantages over the use of a PTC ceramic. For example many PTC conductive polymers are known whose resistivity does not decrease over a temperature range between the switching temperature ($T_s$) and a much higher temperature, e.g. ($T_s$+40)°C., so that by using such conductive polymers, one can eliminate any danger that the additional heat supplied by the second electrical component will cause the PTC element to reach a temperature which is so far above $T_s$ that the composition shows NTC behavior (i.e. its resistivity decreases with an increase in temperature). PTC ceramics, on the other hand, become NTC at a temperature which is not far above, e.g. 20° to 50° C. above, their $T_s$. Another major disadvantage of PTC ceramics is that they are difficult or impossible to form into complex shapes (typically they are formed only into simple plates); this limits their ability to be shaped into conformity with the second component and to provide efficient heat-sinking of the second component. In addition, ceramics are brittle, and this tends to make them crack when they are subjected to the thermal-electrical-mechanical stresses created by "tripping" of a device in which a second component increases the rate at which the temperature of the PTC element increases. PTC conductive polymers, by contrast, can readily be shaped in almost any desired shape by a variety of techniques, e.g. molding, extrusion and sintering and are much better able to withstand thermal-electrical-mechanical stresses than PTC ceramics. Another disadvantage of PTC ceramics, in many cases, is that their resistivity is higher than is desirable.

The invention relates to an electrical apparatus which comprises (1) a first electrical component comprising
  (a) a PTC element composed of a conductive polymer which exhibits PTC behavior with a switching temperature $T_s$ and which has a resistivity which does not decrease in the temperature range $T_s$ to $(T_s+20)$°C.; and
  (b) at least two electrodes which can be connected to a source of electrical power so that current passes between the electrodes through the PTC element;
(2) a second electrical component which
  (a) is physically adjacent to and physically connected to the first component so that it is in good thermal contact with the PTC element, but which is not in direct physical and electrical contact with the first component; and
  (b) is electrically connected to the first component;
(3) an electrical lead which electrically connects the first and second electrical components; and
(4) an electrically insulating component which lies between the first and second electrical components;

the apparatus being suitable for use in an electrical circuit in which, under normal operating conditions, the PTC element is in a low temperature, low resistance state and which, if it is subject to a fault condition which results in excessive current in the circuit, is protected from damage by conversion of the PTC element into a high resistance, high temperature state which reduces the current to a safe level, the second component, when subject to the fault condition, generating heat which is transferred to the PTC element and reduces the time taken to convert the PTC element to the high resistance, high temperature state.

In a preferred embodiment, the invention provides an electrical apparatus which comprises (1) a laminar substrate comprising a first laminar surface and a second laminar surface;
(2) a first electrical component which (i) is physically adjacent to the first laminar surface of the substrate and (ii) has a resistance $R_1$, said first component comprising
  (a) a laminar PTC element composed of a conductive polymer which exhibits PTC behavior with a switching temperature Ts, and
  (b) at least two laminar electrodes which can be connected to a source of electrical power so that current passes between the electrodes through the PTC element;
(3) a second electrical component which
  (a) is physically adjacent to the first laminar surface of the substrate,
  (b) is in good thermal contact with the PTC element,
  (c) is electrically connected in series to the first component, and
  (d) has a resistance $R_2$; and
(4) an electrical lead which electrically connects the first and second components.

The invention further includes electrical circuits which comprise a source of electrical power, a load and a circuit protection apparatus or device as defined above. In such circuits, the first and second electrical components can be connected in series both under the normal operating conditions of the circuit and under the fault conditions (as for example when the second component is a surge resistor in a telephone circuit), or the second component can be one through which no current passes under normal operating conditions but is placed in series with the first component under the fault conditions (as for example when the second component is a VDR which is connected to ground to provide a clampdown in a telephone circuit).

BRIEF SUMMARY OF THE DRAWINGS

The invention is illustrated in the accompanying drawing, in which.

DETAILED DESCRIPTION OF THE INVENTION

Figure 1A:
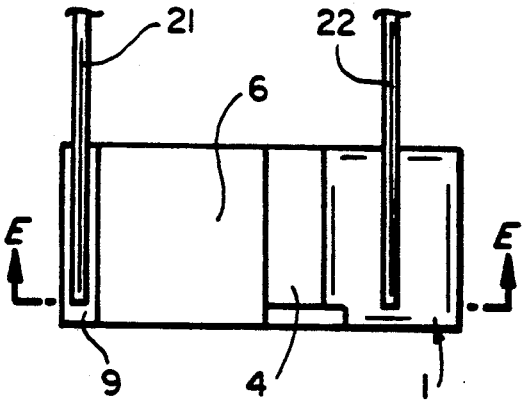
FIG. 1*a* is a plan view and FIG. 1*b* is a cross-sectional view on line E,E of FIG. 1*a* of a first apparatus of the invention.

In the first embodiment of the invention, the second electrical component can be one which is specially designed for the particular performance characteristic required; for example, it can be composed of a ZTC conductive polymer. However, a particular advantage of this embodiment is that it can make use of standard commercially available electrical components as the second electrical component, or at least can make use of standard production techniques to produce suitable second electrical components. In this way, for example, it is possible to make use of a component which has a recognized utility as part of a circuit, e.g. a voltage-dependent resistor (VDR) such as a varistor, a transistor or another electronic component, or a resistor whose resistance is comparatively independent of voltage. The second component can, for example, be a resistor which is a thick film resistor, a thin film resistor, a metallic film resistor, a carbon resistor, a metal wire, or a conductive polymer resistor formed by, for example, melt-shaping (including melt-extrusion, transfer molding and injection molding), solution-shaping (including printing and casting), sintering or any other suitable technique. The resistance of resistors produced by some of these techniques can be changed by laser-trimming techniques. The resistance of the resistor at 23° C. is preferably at least 2 times, particularly at least 5 times, especially at least 10 times or even higher, e.g. at least 20 times, the resistance at 23° C. of the PTC element. The resistance of the resistor preferably does not increase substantially with temperature. For high voltage applications, e.g. where the voltage is greater than about 200 V, the resistance of the resistor is generally at least 20 times, preferably at least 40 times, particularly at least 60 times, or even higher, e.g. at least 100 times, the resistance at 23° C. of the PTC element. The preferred total resistance at 23° C. of the first and second components together will depend on the end use, and may be for example 3 to 2000 ohms, e.g. 5 to 1500 ohms, but is usually 5 to 200 ohms, with the resistance of the PTC element being for example 1 to 100 ohms, usually 1 to 5 ohms.

There can be two or more second electrical components, which can be the same or different. Preferred is an apparatus which acts as a dual hybrid integrated protector in which one second electrical component comprises a thick film resistor and another second electrical component comprises a voltage limiting device. If there are two or more second electrical components, the combined resistance of the second components which are connected in series with a single PTC element is the resistance used when determining the desired ratio of the resistor (or other second component) resistance to that of the PTC element. If the electrical apparatus comprises multiple PTC elements and multiple second components, the resistance of the apparatus is defined as that of each individual PTC element and its associated second components (i.e. those second components which are connected in series with the PTC element). For such apparatus, the resistance of each "unit" comprising a PTC element and second components are preferably the same. Electrical apparatus comprising multiple first and/or second components and substrates is advantageous in providing compact apparatus. Such apparatus requires less space on a circuit board, requires a smaller encapsulation or insulation enclosure, and may respond more rapidly to electrical fault conditions due to better thermal contact between the components. Additionally, the use of multiple components provides the potential for multiple functions.

The leads which are secured to the second electrical component can function not only to connect the component to 5 the circuit and to the first component, but can also be used to provide the electrodes of the first component. For apparatus comprising a laminar substrate, leads may comprise screen-printed ink or sputtered traces.

Suitable PTC conductive polymers for use in this invention are disclosed in the prior art, e.g.. the documents incorporated by reference herein. The conductive polymer should have a resistivity which does not decrease in the temperature range $T_s$ to $(T_s+20)$°C., preferably $T_s$ to $(T_s+40)$°C., particularly $T_s$ to $(T_s+75)$°C.

The insulating element which lies between the first and second components is subject to substantial thermomechanical stress and should be selected accordingly.

A preferred embodiment comprises a laminar substrate. Particularly preferred are substrates which are electrically insulating but have some thermal conductivity, e.g. alumina or berylia. Such substrates may be readily mounted onto a printed circuit board by means of leads. In order to minimize the size of the apparatus on the circuit board, it is preferred that the alumina (or other) substrate have maximum dimensions of 0.100 inch in thickness, 1.5 inch in width, and 0.400 inch in height. This generally allows the apparatus to be lower than the 12 mm (0.47 inch) maximum height constraint of many circuit boards.

In some embodiments, the first and second electrical components are preferably arranged so that the thermal gradient induced in the PTC element is at right angles to the direction of current flow in the PTC element. This is important because the heat flow can otherwise encourage formation of the hot zone adjacent one of the electrodes, which is undesirable. When the second electrical component lies in a cavity in the PTC element between the electrodes, the desired result is usually easy to obtain. However, if the second component is flat, conventional arrangements of the electrodes and the PTC element encourage formation of the hot zone adjacent one of the electrodes. Particularly in this situation, therefore, the first electrical component preferably comprises a planar device, as described in application Ser. No. 103,077, now abandoned, which incorporates a higher resistivity layer in the center plane of the PTC element. In many applications such laminar PTC elements are preferred because they provide better thermal contact to a laminar substrate and can be smaller than PTC elements of other configurations of comparable resistance. Such laminar PTC elements also allow design flexibility. The PTC element may be attached directly to the surface of the laminar element or the second component, or it may be attached to the opposite side of the substrate. For circuit protection devices, the hold current (i.e. the maximum current that can flow through the device without causing the device to pass into its high resistance "tripped" state) may be influenced by the rate of heat dissipated into and out of the PTC element. Thermal transfer can be affected by the distance between the PTC element and the second component.

In some cases the apparatus of the invention may be used to protect the thick film resistor or other second electrical component from damage caused by exposure to high temperatures. Under these conditions, the PTC element is selected such that it is converted to a high resistance state at a temperature below that which causes damage to the resistor.

Figure 2A:
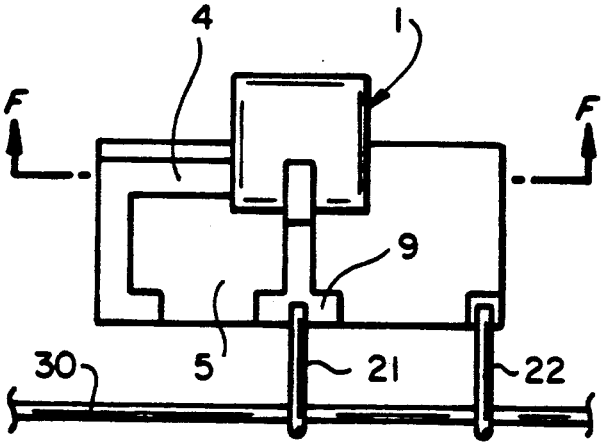
FIG. 2*a* is a plan view and FIG. 2*b* is a cross-sectional view on line F,F of FIG. 2*a* of a second apparatus of the invention.
Figure 2B:
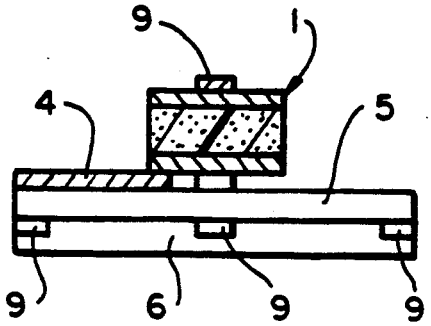
Figure 3:
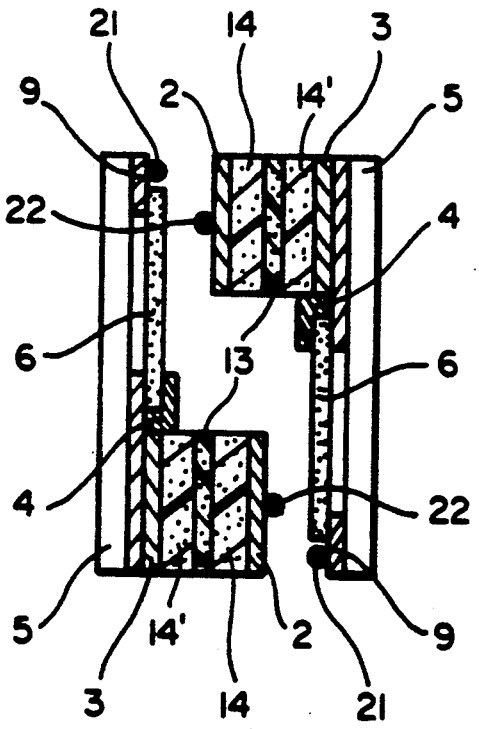
FIG. 3 is a cross-section of a third apparatus of the invention.

Referring now to the drawing, each of FIGS. 1, 2, and 3 shows an apparatus of the invention wherein an insulating member 5 comprises a rigid laminar substrate, often alumina. In each version silver or other conductive paste is screen-printed in a pattern suitable for making connection to the PTC element 1 and a second electrical component.

Figure 1B:
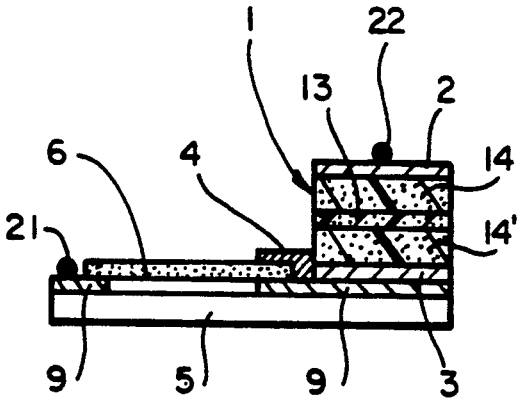

FIGS. 1*a* and 1*b* show an apparatus wherein the PTC element 1 and the second electrical component, a thick film resistor 6, are arranged on the same side of the substrate 5. The PTC element 1 is laminar and comprises a first conductive polymer layer 14,14' on the top and bottom of a second conductive polymer layer 13. Adjacent to each first layer is an electrodeposited nickel foil electrode 2,3. A lead wire 4 connects the bottom electrode 3 of the PTC element to the thick film resistor 6. Leads 21,22 for connecting the apparatus into a circuit are attached to one edge of the silver conductor pad 9 under the thick film resistor and to the top electrode 2 of the PTC element.

FIGS. 2*a* and 2*b* show an alternative version of the invention in which the thick film resistor 6 and the PTC element 1 are on opposite sides of the alumina substrate 5. Also shown is the direction of leads 21, 22 into a printed circuit board 30.

FIG. 3 shows in cross-section an apparatus comprising two devices shown in FIG. 1 which are packaged to minimize the space required on the circuit board.

The invention is illustrated by the following examples.

EXAMPLE 1

Conductive compounds A to D as listed in Table 1 were prepared using a Banbury mixer; each was pelletized. Equal quantities of Compounds A and B were blended together; the blend (Compound I) was extruded into a sheet with a thickness of 0.010 inch (0.025 cm). Equal quantities of Compounds C and D were blended together and the blend (Compound II) was extruded into a sheet with a thickness of 0.020 inch (0.050 cm). A laminated plaque was made by stacking 5 layers of Compound I sheets on either side of a single sheet of Compound II and attaching 0.0014 inch (0.0036 cm) electrodeposited nickel foil electrodes (available from Fukuda) by pressing at 175° C. and cooling under pressure. PTC elements were prepared by cutting 0.3×0.3 inch (0.76×0.76 cm) chips from the plaque. These were processed by heating at 150° C. for one hour, irradiating to a dose of 25 Mrad, heating a second time, irradiating to 150 Mrad, vacuum drying a second time, and heating a third time.

Electrical apparatus made in accordance with this Example is shown in FIGS. 1*a* and 1*b*. Conductor pads (9) made from thick film silver ink (available from ESL) were screen-printed at the edges of a 1.0×0.375×0.050 inch (2.54×0.95×0.13 cm) alumina substrate (5). A layer (6) of ruthenium oxide thick film resistor ink (ESL 3900 Series 10 ohm and 100 ohm/sq inks blended to give a resistance of 20 ohm/sq) was printed in a pattern 0.6×0.375 inch (1.52×0.953 cm) at one edge of the alumina substrate, bridging the conductor pads. A PTC element (1) with a resistance of 2.5 ohms was attached on top of the conductor pad at the other edge via solder. Connection was made between the thick film resistor and the PTC element by means of a wire (4). Lead wires (21, 22) were attached to the top surface electrode (2) of the PTC element and the edge of the thick film resistor. The resulting composite device had a resistance of about 37.5 ohms.

TABLE I

| Formulations of Compounds by Volume Percent | Cpd A | Cpd B | Cpd I | Cpd C | Cpd D | Cpd II |
|---|---|---|---|---|---|---|
| Marlex HXM 50100 | 54.1 | 52.1 | 53.1 | 57.1 | 55.1 | 56.2 |
| Statex G | 28.7 | 30.7 | 29.7 | 25.7 | 27.7 | 26.7 |
| Kisuma 5A | 15.5 | 15.5 | 15.5 | 15.5 | 15.5 | 15.5 |
| Antioxidant | 1.7 | 1.7 | 1.7 | 1.7 | 1.7 | 1.7 |

Marlex HXM 50100 is a high density polyethylene available from Phillips Petroleum.

Statex G is a carbon black available from Columbian Chemicals.

Kisuma 5A is a magnesium hydroxide available from Mitsui.

Antioxidant is an oligomer of 4,4'-thiobis (3-methyl-6-t-butyl phenol) with an average degree of polymerization of 3-4, as described in U.S. Pat. No. 3,986,981.

EXAMPLE 2

Five sheets of Compound I were laminated between two electrodeposited nickel foil electrodes. PTC elements were cut from the plaque and were processed following the procedure of Example 1. Electrical apparatus prepared in accordance with this Example is shown in FIGS. 2*a* and 2*b*.

Silver ink conductor pads (9) were screen-printed on both sides of an 0.8×0.4×0.050 inch (2.0×1.0×0.13 cm) alumina substrate (5). A ruthenium oxide thick film resistor (6) was screen-printed in a 0.8×0.3 inch (2.0×0.76 cm) rectangle on one side of the substrate. The PTC element was attached by solder to the other side. Electrical connection between the components was made by means of a screen-printed lead (4) from the bottom electrode of the PTC element (3) to one edge of the thick film resistor (6).

EXAMPLE 3

Following the procedure of Example 1, electrical apparatus was made. Two individual units were placed adjacent to one another, as shown in FIG. 3, with the PTC elements in the same plane. This packaging design allowed two units to fit into the same space on a circuit board as one unit.

What is claimed is:

1. Electrical apparatus which comprises (1) a first laminar substrate which is electrically insulating and a second laminar substrate, each of said substrates comprising a first laminar surface and a second laminar surface;

(2) a first electrical component which (i) is physically adjacent to the first laminar surface of the first laminar substrate and is mounted directly thereto, (ii) has a resistance $R_1$, and (iii) comprises (a) a laminar PTC elements composed of a conductive polymer which exhibits PTC behavior with a switching temperature $T_s$, and (b) at least two laminar electrodes which can be connected to a source of electrical power so that current passes between the electrodes through the PTC element;

(3) a plurality of second electrical components, one of which (a) is physically adjacent to the first laminar surface of the first laminar substrate and is mounted directly thereto, (b) is in good thermal contact with the first component, (c) is electrically connected in series with the first component, and (d) has a resistance $R_2$; and (4) an electrical lead which electrically connects the first component and the said one second component.

2. Apparatus according to claim 1 wherein the said one second component is a thick film resistor.

3. Apparatus according to claim 1 wherein, when electrical power flows through the first component, a thermal gradient induced in the PTC element is in the same direction as the direction of current flow through the PTC element.

4. Apparatus according to claim 1 which comprises (i) one first component, (ii) two second components, and (iii) two laminar substrates, wherein the first component is positioned between the second components and each second component is physically adjacent to a different laminar substrate.

5. Apparatus according to claim 4 wherein the second components are thick film resistors.

6. Apparatus according to claim 4 wherein the laminar substrates are alumina.

7. Apparatus according to claim 1 which comprises (i) two first components, (ii) four second components, and (iii) three laminar substrates, wherein each first component is positioned between two second components.

8. Apparatus according to claim 7 wherein a first laminar substrate has two opposite laminar surfaces, each of which is physically adjacent to a second component.

9. Apparatus according to claim 4 wherein the ratio of the total resistance at room temperature of the second components connected in series to the PTC element to the resistance at room temperature of the PTC element $R_1$ is at least 20:1.

10. Apparatus according to claim 4 wherein the total resistance at room temperature of the first component and the two second components is at most 500 ohms.

11. Apparatus according to claim 2 wherein the resistor if subject to a temperature exceeding a predetermined level is subject to damage and the PTC element is converted to a high resistance state below said predetermined level.

12. Apparatus according to claim 1 which is mounted on a printed circuit board.

13. Apparatus according to claim 2 wherein the resistor is ruthenium oxide.

14. Apparatus according to claim 2 wherein the resistor is a polymer thick film.

15. Apparatus according to claim 1 wherein the apparatus has a resistance of at most 500 ohms.

16. Apparatus according to claim 15 wherein the apparatus has a resistance of at most 100 ohms.

17. Apparatus according to claim 1 wherein each of the second components has the same resistance $R_2$.

18. Apparatus according to claim 1 which comprises (i) one first component, (ii) two second components, and (iii) two laminar substrates, wherein the first component is positioned between the two laminar substrates and each second component is physically adjacent to a different laminar substrate.

19. Apparatus according to claim 18 wherein the second components are thick film resistors.

20. Apparatus according to claim 18 wherein the laminar substrates are alumina.

21. Apparatus according to claim 18 wherein the ratio of the total resistance at room temperature of the second components connected in series to the PTC element to the resistance at room temperature of the PTC element $R_1$ is at least 20:1.

22. Apparatus according to claim 18 wherein the total resistance at room temperature of the first component and the two second components is at most 500 ohms.

23. An electrical circuit comprising (1) a power source;

(2) an electrical load; and (3) a circuit protection device which is in series with the load and which comprises (a) a first laminar substrate which is electrically insulating and a second laminar substrate, each of said substrates comprising a first laminar surface and a second laminar surface;

(b) a first electrical component which is physically adjacent to the first laminar surface of the first laminar substrate and is mounted directly thereto, said first component comprising (i) a laminar PTC element composed of a conductive polymer which exhibits PTC behavior with a switching temperature Ts, and (ii) at least two laminar electrodes which can be connected to source of electrical power so that current passes between the electrodes through the PTC element;

(c) a plurality of second electrical components, one of which (i) is physically adjacent to the first laminar surface of the first laminar substrate, (ii) is in good thermal contact with the first component, and (iii) is electrically connected in series with the first component; and (d) an electrical lead which electrically connects the first and second components, said circuit having a normal operating condition in which the PTC conductive polymer composition of the circuit protection device is in its low temperature, low resistivity state.

* * * * *

UNITED STATES PATENT AND TRADEMARK OFFICE

CERTIFICATE OF CORRECTION

PATENT NO. : 5,089,688

DATED : February 18, 1992

INVENTOR(S) : Fang et al

It is certified that error appears in the above-indentified patent and that said Letters Patent is hereby corrected as shown below:

The sheets of drawings, consisting of Figs. 4A, 4B, 5 and 6, should be added as shown on the attached pages.

UNITED STATES PATENT AND TRADEMARK OFFICE

CERTIFICATE OF CORRECTION

PATENT NO. : 5,089,688

DATED : February 18, 1992

INVENTOR(S) : Fang et al

It is certified that error appears in the above-indentified patent and that said Letters Patent is hereby corrected as shown below:

Column 3, line 47, replace "a laminar substrate comprising" by --a first laminar substrate and a second laminar substrate, each of said substrates comprising--.

Column 3, line 50, replace "the substrate" by --the first laminar substrate--.

Column 3, lines 51 to 52, replace "resistance $R_1$, said first component comprising" by --resistance $R_1$, and (iii) comprises--.

Column 3, line 60, replace "a second electrical component which" by --a plurality of second electrical components, one of which--.

Column 3, line 62, replace "the substrate" by --the first laminar substrate--.

Column 3, line 63, replace "the PTC element," by --the first component,--

UNITED STATES PATENT AND TRADEMARK OFFICE

CERTIFICATE OF CORRECTION

PATENT NO. : 5,089,688

DATED : February 18, 1992

INVENTOR(S) : Fang et al

It is certified that error appears in the above-indentified patent and that said Letters Patent is hereby corrected as shown below:

Column 3, line 64, replace "to" by --with--.

Column 3, line 68, replace "first and second components." by --first component and the said one second component.--.

Column 4, lines 21 to 22, replace "a first apparatus of the invention;" by --an electrical apparatus;--.

Column 4, lines 24 to 25, replace "a second apparatus of the invention;" by --another electrical apparatus;--.

Column 4, lines 26 to 27, replace "third apparatus of the invention." by --third electrical apparatus.--.

Figure 4A:
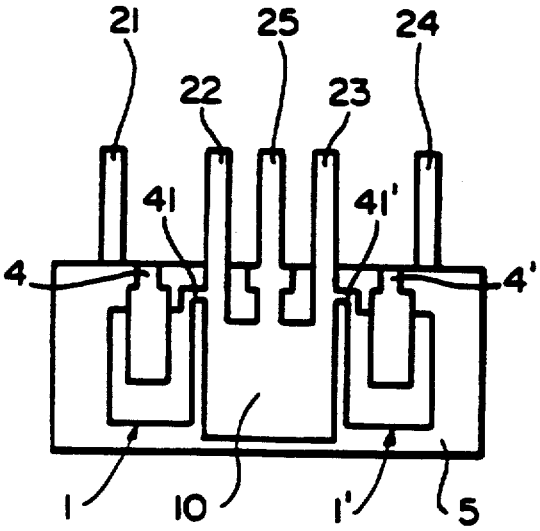
Figure 4B:
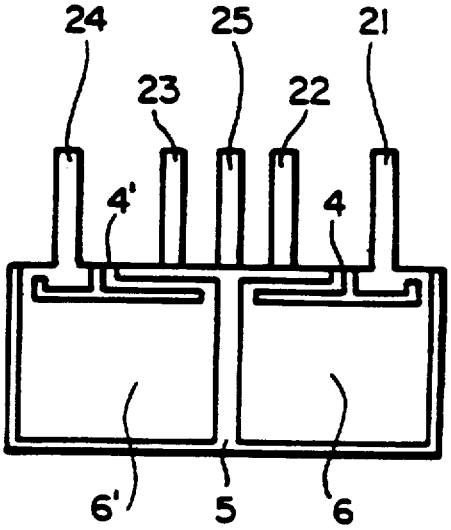
Figure 5:
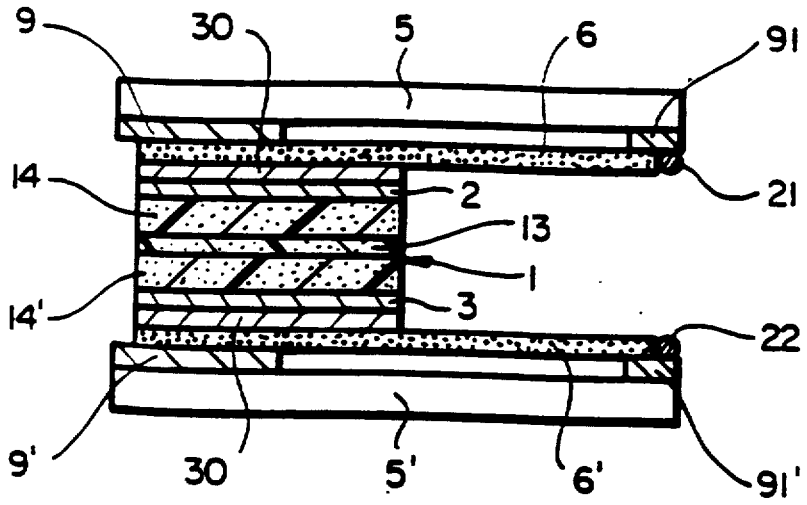
Figure 6:
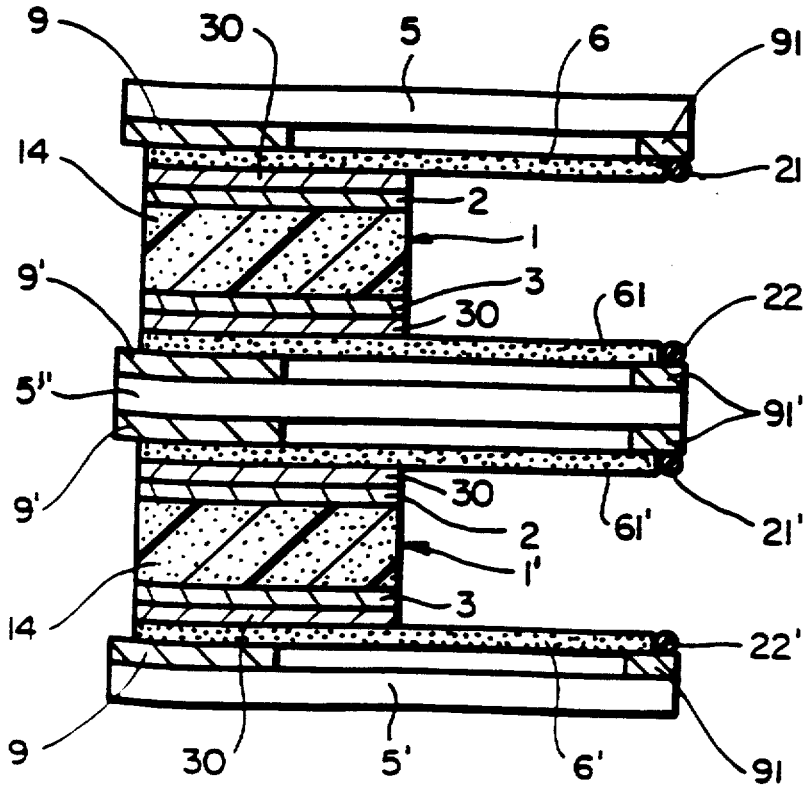

Column 4, line 28, before "Detailed Description of the Invention" insert --Figures 4a and 4b are plan views of two different sides of a first apparatus of the invention, and Figures 5 and 6 are cross-sections of a second apparatus of the invention.--

UNITED STATES PATENT AND TRADEMARK OFFICE

CERTIFICATE OF CORRECTION

PATENT NO. : 5,089,688

DATED : February 18, 1992

INVENTOR(S) : Fang et al

It is certified that error appears in the above-indentified patent and that said Letters Patent is hereby corrected as shown below:

Column 5, line 33, delete "5".

Column 6, lines 32 to 33, replace "drawing, each of FIGS. 1, 2 and 3 shows an apparatus of the invention wherein an" by --drawing, Figures 1 to 6 illustrate versions of the invention wherein the--

Column 6, lines 52 to 53, replace "version of the invention in which" by --version in which--.

Column 6, line 59, after "circuit board." insert the following three (3) paragraphs.

--Figures 4a and 4b show the opposite sides of the alumina substrate 5 used in a version of the invention comprising three electrical components. Two thick film resistors 6,6' are screen-printed adjacent to one another on one side of the substrate. On the other side of the substrate, two PTC elements 1,1' are positioned adjacent to a voltage limiting device 10. Electrical

UNITED STATES PATENT AND TRADEMARK OFFICE

CERTIFICATE OF CORRECTION

PATENT NO. : 5,089,688

DATED : February 18, 1992

INVENTOR(S) : Feng et al

It is certified that error appears in the above-indentified patent and that said Letters Patent is hereby corrected as shown below:

connections are made independently between PTC element 1 and thick film resistor 6 and between PTC element 1' and thick film resistor 6' by means of silver paste or solder leads 4,4'. Connection is made between PTC element 1 and voltage limiting device 10 by means of lead 41, 41'. Leads 21,22 and 23,24 are used to connect the device to the circuit. Ground lead 25 is attached to the voltage limiting device.--

--Figure 5 shows an apparatus in which the PTC element 1 is sandwiched between two ruthenium oxide resistors 6,6', each of which is printed onto a separate alumina substrate 5,5'. The PTC element is attached to the substrate by means of a solder layer 30 between the electrodeposited foil electrodes 2,3 and the resistors 6,6'. Wire leads 21, 22 are attached to conductor pads 91,91' and allow the current to flow from the lead through a first resistor 6, through the PTC element 1, and then through a second resistor 6'.--

UNITED STATES PATENT AND TRADEMARK OFFICE

CERTIFICATE OF CORRECTION

PATENT NO. : 5,089,688

DATED : February 18, 1992

INVENTOR(S) : Fang et al

It is certified that error appears in the above-indentified patent and that said Letters Patent is hereby corrected as shown below:

--Figure 6 shows an apparatus containing multiple components. Two PTC elements 1,1' are soldered (layer 30) onto opposite sides of a laminar substrate 5'', each side of which has been printed with resistors 61,61'. Two additional substrates 5,5' are attached to the remaining side of each PTC element. Wire leads 21,22,21',22' are attached to conductor pads 91,91' to provide two separate units which may be individually powered.--

Column 7, Table I, line 4, insert --Material-- over the left-hand column of the table.

Column 8, line 10, after "one unit." insert the following three (3) paragraphs.

--Example 4

Electrical apparatus in accordance with this Example is shown in Figures 4a and 4b. Two PTC element (1,1') were placed on one side of an alumina substrate (5) adjacent a voltage It is certified that error appears in the above-indentified patent and that said Letters Patent is hereby corrected as shown below:

limiting device (10). Two ruthenium oxide thick film resistors (6,6') were screen-printed adjacent to one another on the opposite side of the substrate. Electrical connection was made between a resistor (6) and a PTC element (1) by means of a screen-printed lead (4). Electrical connection was also made between the PTC element (1) and the voltage limiting device (10) by means of another screen-printed lead (41). The second resistor (6') was connected to the second PTC element (1') by lead (4'). The second PTC element (1') was connected to the voltage limiting device (10) by similar means(41') to the first PTC element.--

--Example 5

Electrical apparatus made in accordance with this Example is shown in Figure 5. A PTC element was made following the procedure of Example 1. Conductor pads (9,9',91,91') and a thick film resistor (6,6') were screen-printed onto one side of two alumina substrates as in Example 1. A PTC element (1) with a

UNITED STATES PATENT AND TRADEMARK OFFICE

CERTIFICATE OF CORRECTION

PATENT NO. : 5,089,688

DATED : February 18, 1992

INVENTOR(S) : Fang et al

It is certified that error appears in the above-indentified patent and that said Letters Patent is hereby corrected as shown below:

resistance of 2 ohms was positioned between the resistor on each substrate and attached with solder (30). Lead wires (21,22) were attached to a conductor pad (91,91') on each substrate so that, when connected to a source of electrical power, the current would flow from lead 21 through resistor 6, PTC element 1 and resistor 6'. The total resistance of the apparatus was 100 ohms.--

--Example 6

Electrical apparatus of this Example is shown in Figure 6. Two PTC elements were made following the procedure of Example 2. Two laminar substrates (5,5') were prepared as described in Example 5. A third laminar substrate (5'') was prepared by printing conductor pads and ruthenium oxide resistors (61,61') on both laminar surfaces. Using solder, the PTC elements were each positioned between a single-coated substrate (5,5') and a double-coated substrate (5''). Four lead wires (21,22,21',22') were attached to four conductor pads (91,91').--

UNITED STATES PATENT AND TRADEMARK OFFICE

CERTIFICATE OF CORRECTION

PATENT NO. : 5,089,688

DATED : February 18, 1992

INVENTOR(S) : Fang et al

It is certified that error appears in the above-indentified patent and that said Letters Patent is hereby corrected as shown below:

Column 8, line 21,(Claim 1) replace "elements" by --element--.

Signed and Sealed this

Seventh Day of November, 1995

*Attest:*

Bruce Lehman

BRUCE LEHMAN

*Attesting Officer*

*Commissioner of Patents and Trademarks*